US010895817B2

(12) United States Patent
Imai et al.

(10) Patent No.: US 10,895,817 B2
(45) Date of Patent: Jan. 19, 2021

(54) IMAGE FORMING APPARATUS

(71) Applicant: CANON KABUSHIKI KAISHA, Tokyo (JP)

(72) Inventors: Yuichiro Imai, Tokyo (JP); Yasuaki Otoguro, Abiko (JP); Yuta Okada, Moriya (JP); Toshiki Momoka, Tokyo (JP); Yoshitaka Otsubo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/698,107

(22) Filed: Nov. 27, 2019

(65) Prior Publication Data

US 2020/0174417 A1 Jun. 4, 2020

(30) Foreign Application Priority Data

Dec. 4, 2018 (JP) ..... 2018-227619

(51) Int. Cl.
*G03G 15/04* (2006.01)
*G03G 15/01* (2006.01)

(52) U.S. Cl.
CPC ..... *G03G 15/04036* (2013.01); *G03G 15/011* (2013.01)

(58) Field of Classification Search
CPC ..... G03G 15/04; G03G 15/011; G03G 15/04036; G03G 21/16; G03G 21/1666; G03G 2215/0402; G03G 2221/1636
See application file for complete search history.

(56) References Cited

U.S. PATENT DOCUMENTS 7,522,326 B1 4/2009 Otoguro ..... 347/256
7,684,099 B2 3/2010 Otoguro ..... 359/216.1
8,810,622 B2 8/2014 Mamiya et al. ..... 347/242
8,917,305 B2 12/2014 Nakahata et al. ..... 347/244
8,947,478 B2 2/2015 Ishidate et al. ..... 347/137
9,086,645 B2 7/2015 Otoguro et al. ... G03G 15/0435
9,195,063 B2 11/2015 Ishidate et al. .. G03G 15/04072
9,316,992 B2 4/2016 Ishidate et al. ..... G03G 15/80
9,400,444 B2 7/2016 Sato et al. ..... G03G 15/043
9,493,014 B2 11/2016 Aruga et al. ..... B41J 2/471
(Continued)

FOREIGN PATENT DOCUMENTS

JP 2016-031466 3/2016

OTHER PUBLICATIONS

U.S. Appl. No. 16/793,315 filed Feb. 18, 2020.
U.S. Appl. No. 16/697,673 filed Nov. 27, 2019.

*Primary Examiner* — Thomas S Giampaolo, II
(74) *Attorney, Agent, or Firm* — Venable LLP

(57) ABSTRACT

An image forming apparatus which includes an optical scanning device, wherein the optical scanning device includes: a holding member configured to integrally hold a first cleaning member and a second cleaning member; a first guide member configured to guide a movement of the holding member; and a second guide member configured to guide a movement of the holding member. A first protruding portion protrudes upward from an upper surface of the holding member and is provided at a position closer to an end portion of the holding member than the first cleaning member, and a second protruding portion protrudes upward from the upper surface of the holding member and is provided at a position closer to an end portion of the holding member than the second cleaning member. The first protruding portion and second protruding portion are provided for bending the holding member.

16 Claims, 15 Drawing Sheets

(56) References Cited

U.S. PATENT DOCUMENTS

| | | | | |
|---|---|---|---|---|
| 9,517,638 | B2 | 12/2016 | Otoguro et al. | B41J 2/471 |
| 9,720,207 | B2 | 8/2017 | Otoguro et al. | G03G 15/0435 |
| 9,906,663 | B2 | 2/2018 | Otsubo | G03G 15/04045 |
| 9,927,732 | B2 | 3/2018 | Otsubo | G03G 15/04045 |
| 10,061,119 | B2 | 8/2018 | Ogura et al. | G02B 7/181 |
| 10,185,119 | B2 | 1/2019 | Ishidate et al. | G02B 7/1821 |
| 10,274,860 | B2 | 4/2019 | Otoguro et al. | G03G 15/04072 |
| 10,303,080 | B2 | 5/2019 | Ishidate et al. | B41J 2/47 |
| 10,303,081 | B2 | 5/2019 | Ishidate et al. | G03G 15/04036 |
| 10,324,396 | B2 | 6/2019 | Imai et al. | G02B 26/12 |
| 10,389,897 | B2 | 8/2019 | Imai | G02B 26/127 |
| 10,451,870 | B2 | 10/2019 | Okada et al. | G02B 26/121 |
| 10,473,922 | B2 | 11/2019 | Aruga et al. | G02B 26/121 |
| 10,484,566 | B2 | 11/2019 | Namba et al. | G02B 26/123 |
| 10,498,920 | B2 | 12/2019 | Okada et al. | H04N 1/00649 |
| 10,520,851 | B2 | 12/2019 | Aruga et al. | G03G 15/0435 |
| 10,558,140 | B2 | 2/2020 | Okada et al. | G02B 7/182 |
| 2016/0033923 | A1 | 2/2016 | Sumikura et al. | G03G 21/0005 |
| 2017/0064108 | A1 | 3/2017 | Mamiya et al. | H04N 1/00525 |
| 2018/0231768 | A1 | 8/2018 | Nakahata et al. | G02B 26/123 |
| 2020/0073277 | A1 | 3/2020 | Ogura et al. | G03G 15/04072 |

IMAGE FORMING APPARATUS

BACKGROUND OF THE INVENTION

Field of the Invention

The present invention relates to an image forming apparatus such as an electro-photographic copying machine or a laser beam printer that forms an image on a recording medium using an electro-photographic process.

Description of the Related Art

In an electro-photographic image forming apparatus, an optical scanning device (optical scanning unit) that scans a charged photosensitive body with a laser beam to form an electrostatic latent image is mounted. Further, an opening for allowing laser light to pass through is formed on the housing of the optical scanning device. This opening is closed by a transmissive member that transmits laser light in order to prevent foreign matters such as toner and dust from entering the optical scanning device.

When a foreign matter exists on the surface of the transmissive member, some of the laser light passing through the transmissive member is blocked by this foreign matter, so that the optical characteristics may be deteriorated and the image quality may be lowered. In order to overcome this problem, Japanese Patent Application Laid-Open No. 2016-31466 discloses a configuration in which a foreign matter on the surface of the transmissive member is removed by a cleaning member such as a pad or a blade that is moved while being in contact with or pressed against the transmissive member in a way similar to a wiper. The cleaning member disclosed in Japanese Patent Application Laid-Open No. 2016-31466 is held by a cleaning holder, and the cleaning holder is fixed to a wire. The cleaning holder moves by the wire that is moved by a motor, and the cleaning member cleans the transmissive member as the cleaning holder moves. The cleaning holder is engaged with a guide rail provided in the vicinity of the transmissive member and moves along the guide rail.

When the cleaning member is used for a long period of time, the cleaning member itself is contaminated, and there is a possibility that the transmission member is more contaminated when the cleaning operation is performed. For this reason, it is desirable to periodically replace the cleaning member. Therefore, it is preferable that an operator can easily replace the cleaning member, and in particular, it is desired that the cleaning holder has such a shape that the cleaning holder can be easily detached from the guide rail.

Accordingly, the present invention has been made in view of the above, and an object thereof is to provide an image forming apparatus capable of improving the exchangeability of the cleaning member.

SUMMARY OF THE INVENTION

A representative configuration of the present invention is an image forming apparatus, comprising:

a first photosensitive body;

a second photosensitive body;

a first developing portion configured to develop an electrostatic latent image formed on the first photosensitive body with toner;

a second developing portion configured to develop an electrostatic latent image formed on the second photosensitive body with toner; and an optical scanning device disposed below the first photosensitive body, the second photosensitive body, the first developing portion and the second developing portion in a vertical direction, wherein the optical scanning device comprises:

a rotary polygon mirror configured to deflect a first laser beam and a second laser beam such that the first laser beam scans the first photosensitive body and second laser beam scans the second photosensitive body;

a housing in which the rotary polygon mirror is accommodated, a first opening portion through which the first laser beam passes from an inside of the housing to an outside of the housing and a second opening portion through which the second laser beam passes from the inside of the housing to the outside of the housing being formed on the housing, the first opening portion being configured to be long in a scanning direction of the first laser beam, the second opening portion being configured to be long in a scanning direction of the second laser beam;

a first transmissive member through which the first laser beam transmits, the first transmissive member being configured to close the first opening portion;

a second transmissive member through which the second laser beam transmits, the second transmissive member being configured to close the second opening portion;

a first cleaning member configured to be in contact with a surface of the first transmissive member which surface faces the outside of the housing in order to clean the surface of the first transmissive member;

a second cleaning member configured to be in contact with a surface of the second transmissive member which surface faces the outside of the housing in order to clean the surface of the second transmissive member;

a holding member configured to integrally hold the first cleaning member and the second cleaning member, the holding member having flexibility;

a moving unit configured to move the holding member such that the first cleaning member and the second cleaning member move in a first direction that is a longitudinal direction of the first transmissive member and the second transmissive member;

a first guide portion configured to guide a movement of the holding member, the first guide portion extending in the first direction, an end portion side of the holding member in a second direction that crosses the first direction and the vertical direction being configured to engage with the first guide portion; and a second guide portion configured to guide a movement of the holding member, the second guide portion extending in the first direction, another end portion side of the holding member in the second direction being configured to engage with the second guide portion, and wherein a first protruding portion that protrudes upward from an upper surface of the holding member is provided on the holding member at a position closer to an end portion of the holding member in the second direction than the first cleaning member, and a second protruding portion that protrudes upward from the upper surface of the holding member is provided on the holding member at a position closer to an end portion of the holding member in the second direction than the second cleaning member, the first protruding portion and second protruding portion being for bending the holding member in the second direction.

Further features of the present invention will become apparent from the following description of exemplary embodiments with reference to the attached drawings.

DESCRIPTION OF THE EMBODIMENTS

First Embodiment

<Image Forming Apparatus>

First, the overall configuration of the image forming apparatus according to the first embodiment of the present invention will be described together with the operation during image formation with reference to the drawings. It should be noted that the dimensions, materials, shapes, relative arrangements, and the like of the components described below are not intended to limit the scope of the present invention only to those unless otherwise specified.

The image forming apparatus A according to the present embodiment is a full-color laser printer in which toners of four colors, yellow Y, magenta M, cyan C, and black K are transferred onto an intermediate transfer belt, and then the toners of four colors on the intermediate transfer belt are transferred to a sheet to form an image. In the following description, the members using the toners of the respective colors are given the suffixes Y, M, C, and K. However, these suffixes are appropriately omitted unless the distinction between them is necessary since the configuration and operation of each member is substantially the same except for the colors of the used toners.

Figure 1:
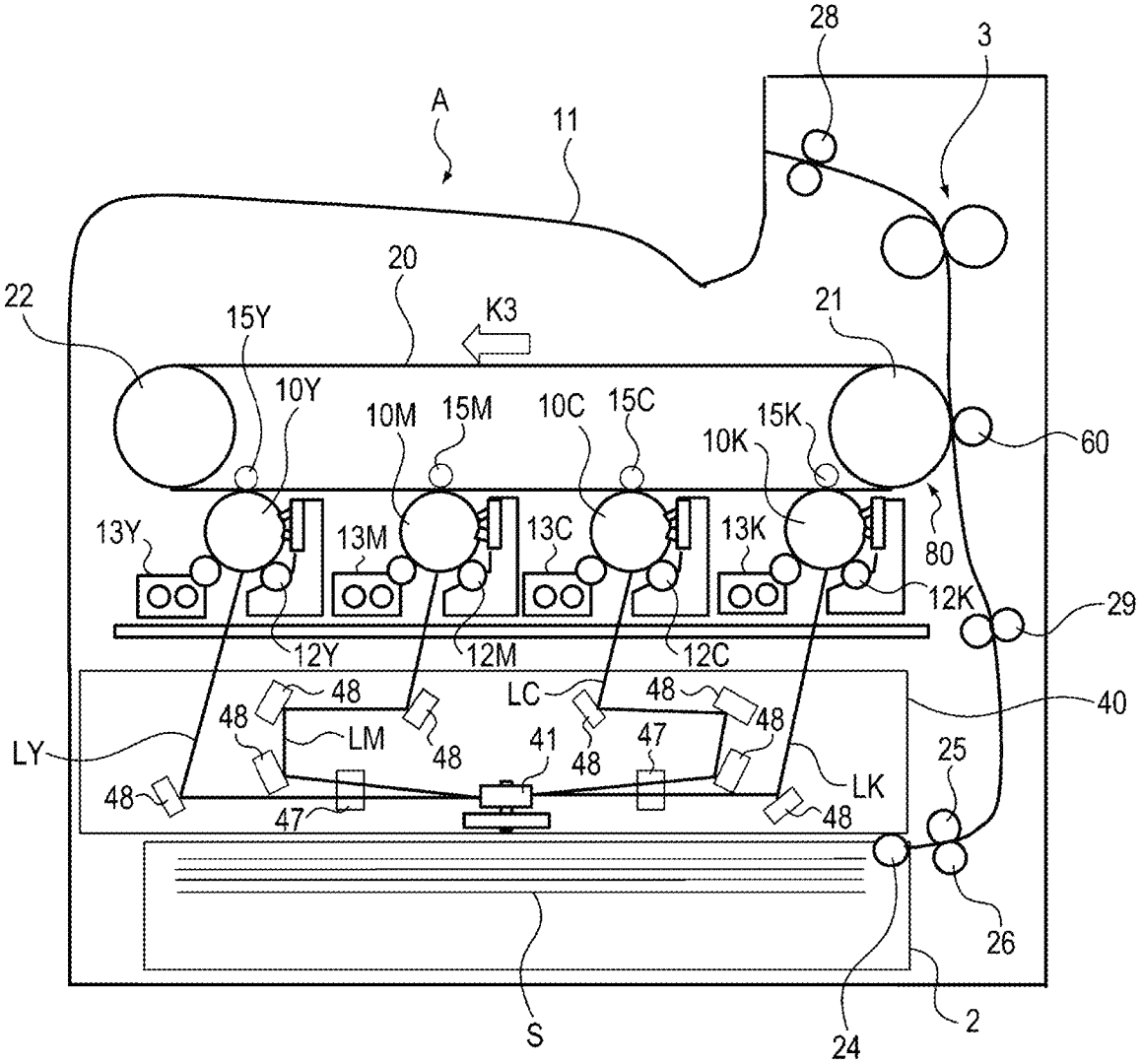
FIG. 1 is a schematic cross-sectional view of an image forming apparatus.

As shown in FIG. 1, the image forming apparatus A includes an image forming portion that transfers a toner image onto a sheet to form an image, a sheet feeding portion that supplies the sheet to the image forming portion, and a fixing portion that fixes a toner image on the sheet.

The image forming portion includes the photosensitive drums 10 (10Y, 10M, 10C and 10K) that are photosensitive members, the charging rollers 12 (12Y, 12M, 12C and 12K) that charge the surface of the photosensitive drums 10, and the developing devices 13 (13Y, 13M, 13C and 13K). The image forming portion further includes the primary transfer rollers 15 (15Y, 15M, 15C and 15K), the optical scanning device 40, and the intermediate transfer unit 80.

The intermediate transfer unit 80 includes the intermediate transfer belt 20, the secondary transfer roller 60, the belt driving rollers 21 and 22, and the like. The intermediate transfer belt 20 is an endless belt stretched around the belt driving rollers 21 and 22, and rotates in the direction of the arrow K3 as the belt driving rollers 21 and 22 rotate.

The optical scanning device 40 (optical scanning unit) is disposed below the photosensitive drums 10 and the developing devices 13 in the vertical direction. The optical scanning device 40 includes the light source portion 43 (see FIGS. 2 and 3) having four semiconductor lasers (not shown) as light sources that emit laser beams L (LY, LM, LC and LK) modulated in accordance with image information of respective colors (see FIG. 4). The optical scanning device 40 has the rotary polygon mirror 41 as a deflection device. The rotary polygon mirror 41 deflects the laser beams of colors so that the laser beams corresponding to respective colors emitted from the light sources respectively scan on the corresponding photosensitive drums 10.

In the optical scanning device 40, the laser beams L deflected by the rotary polygon mirror 41 are guided by the scanning lenses 47 and the mirrors 48 provided in the optical scanning device 40 so that the laser beams L travel along predetermined paths. Then, the laser beams L that have traveled along the predetermined paths pass through the irradiation openings 42 provided in the upper part of the optical scanning device 40 and are irradiated onto the photosensitive drums 10. That is, the respective laser beams L are deflected by the rotary polygon mirror 41 and guided to the corresponding photosensitive drums 10 by the scanning lenses 47 and the mirrors 48. The laser beams L respectively scan the photosensitive drums 10 along the rotational axis direction of the photosensitive drums 10. The optical scanning device 40 scans the surfaces of the photosensitive drums 10 in the main scanning direction with the laser beams L whose deflection angles are changed by the rotation of the rotary polygon mirror 41.

Next, an image forming operation will be described. First, when the control portion (not shown) receives an image forming job signal, the sheets S stacked and stored in the sheet stacking unit 2 are separated into one sheet by the retard roller 26 and conveyed to the registration roller 29 by the feeding roller 24 and the transporting roller 25. Next, after the timing correction for the sheet S is performed by the registration roller 29, the sheet S is conveyed to the secondary transfer portion configured by the secondary transfer roller 60 and the belt driving roller 21.

On the other hand, in the image forming portion, the surface of the photosensitive drum 10Y is firstly charged by the charging roller 12Y. Thereafter, the optical scanning device 40 irradiates the surface of the photosensitive drum 10Y with the laser beam LY in accordance with an image signal transmitted from an external device (not shown) or the like, thereby forming an electrostatic latent image on the surface of the photosensitive drum 10Y.

Thereafter, yellow toner is attached to the electrostatic latent image formed on the surface of the photosensitive drum 10Y by the developing device 13Y to form a yellow toner image on the surface of the photosensitive drum 10Y. The toner image formed on the surface of the photosensitive drum 10Y is primarily transferred to the intermediate transfer belt 20 by applying a primary transfer bias to the primary transfer roller 15Y.

Through similar processes, magenta, cyan, and black toner images are also formed on the photosensitive drums 10M, 10C, and 10K, respectively. Then, by applying a primary transfer bias to the primary transfer rollers 15M, 15C, and 15K, these toner images are transferred onto the intermediate transfer belt 20 in a superimposed manner with the yellow toner image. As a result, a full-color toner image is formed on the surface of the intermediate transfer belt 20.

Thereafter, this full-color toner image is conveyed to the secondary transfer unit by the rotation of the intermediate transfer belt 20. Then, in the secondary transfer portion, a secondary transfer bias is applied to the secondary transfer roller 60, so that the full-color toner image on the intermediate transfer belt 20 is transferred to the sheet S.

Next, the sheet S to which the toner image has been transferred is heated and pressed in the fixing device 3, so that the toner image on the sheet S is fixed to the sheet S. Thereafter, the sheet S on which the toner image has been fixed is discharged to the discharge portion 11 by the discharge roller 28.

When the photosensitive drum 10Y is referred to as a first photosensitive body, any one of the photosensitive drums 10M, 10C, and 10K is referred to as a second photosensitive body. When the photosensitive drum 10M is referred to as a first photosensitive body, any one of the photosensitive drums 10Y, 10C, and 10K is referred to as a second photosensitive body. That is, when one of the photosensitive drums 10Y, 10M, 10C, and 10K is referred to as a first photosensitive body, any one of the other photosensitive drums is referred to as a second photosensitive body. Similarly, when the developing device 13Y is referred to as a first developing portion, any one of the developing devices 13M, 13C, and 13K is referred to as a second developing portion. That is, when one of the developing devices 13Y, 13M, 13C, and 13K is referred to as a first developing portion, any one of the other developing devices is referred to as a second developing portion.

<Optical Scanning Device>

Next, the configuration of the optical scanning device 40 will be described.

Figure 2:
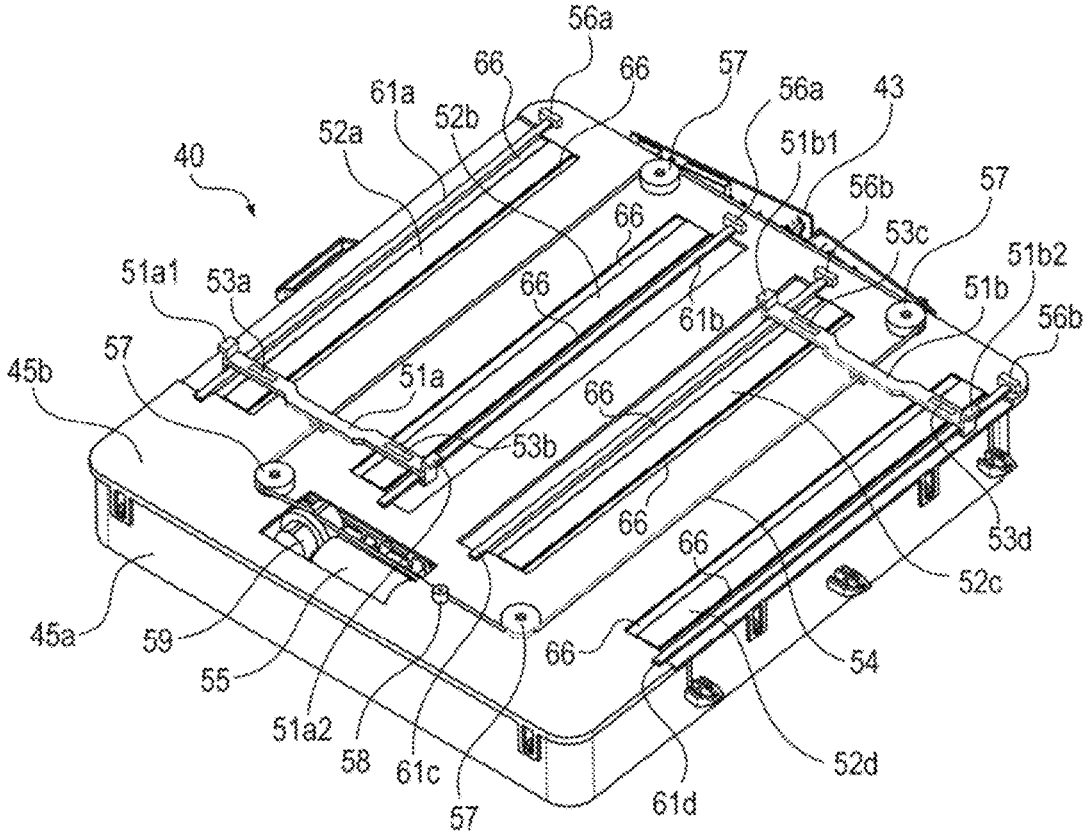
FIG. 2 is a perspective view of an optical scanning device.
Figure 3:
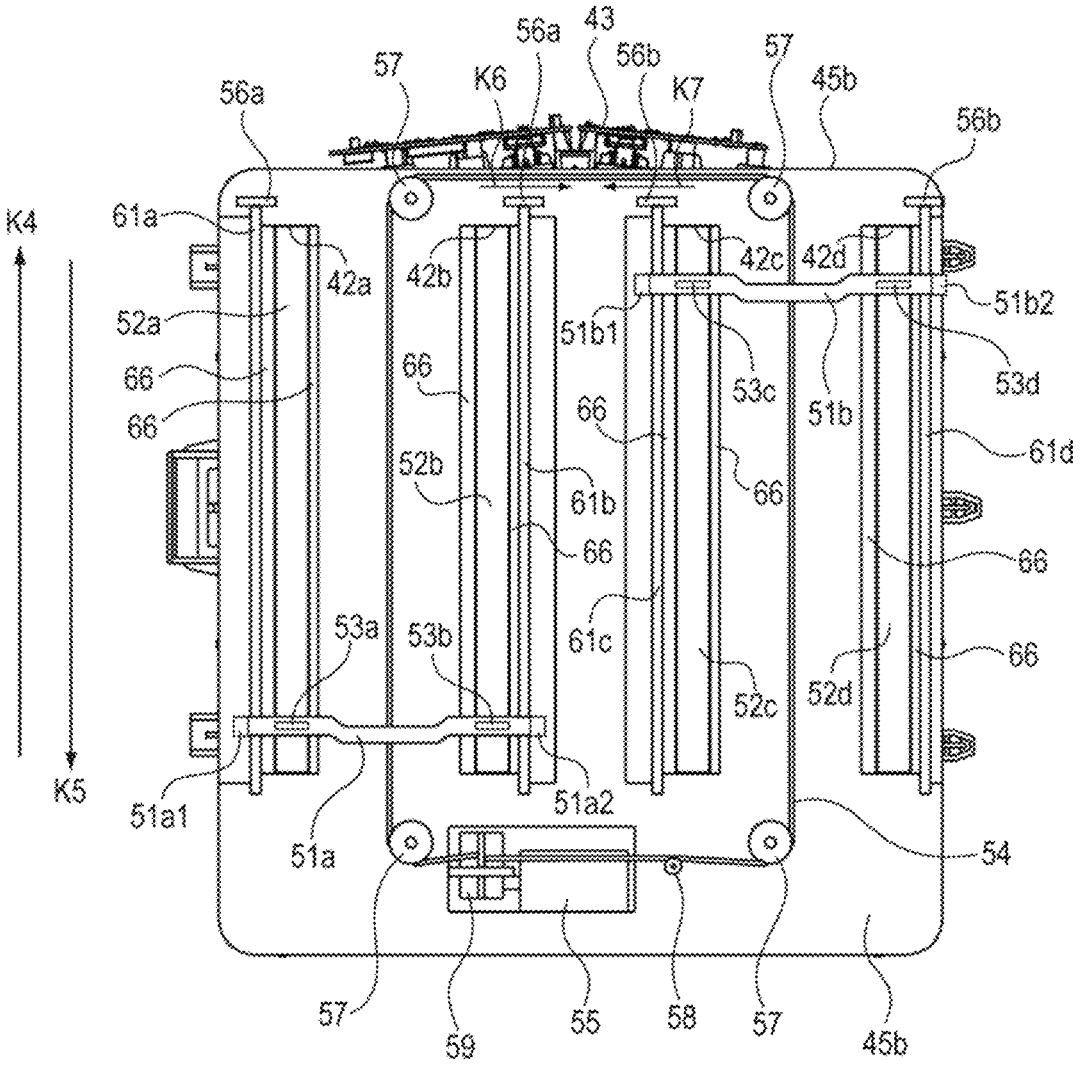
FIG. 3 is a top view of the optical scanning device.

FIGS. 2 and 3 are a perspective view and a top view of the optical scanning device 40, respectively. As shown in FIGS. 2 and 3, the optical scanning device 40 includes the optical box 45*a* whose top is opened, and the cover 45*b* that covers the open top of the optical box 45*a*. The optical box 45*a* and the cover 45*b* serve as a housing in which optical members such as the rotary polygon mirror 41 and the scanning lenses 47 are housed. A substantially hermetically sealed space is formed by the optical box 45*a* and the cover 45*b*. The rotary polygon mirror 41, the scanning lenses 47, and the mirrors 48 are disposed in this hermetically sealed space. As a result, the reflecting surface of the rotary polygon mirror 41, the scanning lenses 47, and the mirrors 48 are protected from dust including scattered toner outside the optical scanning device 40.

The irradiation openings 42 (42*a* to 42*d*) are opening portions (openings for laser passage) formed on the cover 45*b* (a part of the housing) through which the laser beams L pass from the inside of the optical box (hermetically sealed space side of the optical scanning device 40) to the outside of the optical box. The laser beams L are emitted from semiconductor lasers (not shown) that are light sources and scan the photosensitive drums 10. Here, the irradiation opening 42 through which the laser beam L that scans the first photosensitive body is referred to as a first opening portion, and the irradiation opening 42 through which the laser beam L which scans the second photosensitive body is referred to as a second opening portion.

As shown in FIG. 3, the irradiation openings 42 are separately provided for respective colors. The irradiation openings 42 have a rectangular shape whose longitudinal direction is the main scanning direction of the laser beams L deflected by the rotary polygon mirror 41. The irradiation openings 42 are formed so that the longitudinal directions thereof are parallel to each other. The shape of the irradiation openings 42 is not limited to this as long as the laser beams L can pass through the irradiation openings.

In addition, the irradiation openings 42 respectively have four transmissive members 52 (52*a* to 52*d*) that close them from the outside of the cover 45*b* in order to prevent foreign matter such as toner and dust from entering the inside of the housing of the optical scanning device 40. Here, the transmissive member 52 that closes the first opening portion described above is referred to as a first transmissive member, and the transmissive member 52 that closes the second opening portion is referred to as a second transmissive member.

The transmissive member 52 has transmission property by which the laser beam L emitted from a semiconductor laser (not shown) transmits through the transmissive member 52 and the laser beam produced by a semiconductor laser may be emitted to the photosensitive drums 10. In the present embodiment, the outer side of the transmissive member 52 with respect to the optical scanning device 40 is a light-emitting surface, and the inner side with respect to the optical scanning device 40 is a light incident surface. The transmissive member 52 has a rectangular shape whose longitude direction is the main scanning direction of the laser beam L deflected by the rotary polygon mirror 41. The transmitting member 52 is, for example, a glass cover, but may be made of plastic or the like as long as the laser beam may transmit through the material.

As described above, the optical scanning device 40 is configured to prevent foreign matters such as toner, paper powder, and dust from entering the optical scanning device 40 by being covered with the cover 45*b* and the transmissive member 52. Further, by fixing the transmissive member 52 larger than the irradiation opening 42 on the cover 45*b*, foreign matters such as toner, paper powder, and dust falling from above the optical scanning device 40 are prevented from entering the inside of the optical scanning device 40 via the gap between the transmission member 52 and irradiation opening 42.

The optical scanning device 40 is provided with two cleaning holders 51 (51*a*, 51*b*) as holding members, which are mainly made of POM (polyacetal resin) and have flexibility. The cleaning holder 51*a* engages with guide rails 61*a* and 61*b* formed on the cover 45*b*, and extends so as to straddle the two adjacent transmissive members 52*a* and 52*b*. The cleaning holder 51*b* engages with guide rails 61*c* and 61*d* formed on the cover 45*b*, and extends so as to straddle two adjacent transmissive members 52*c* and 52*d*.

That is, the longitudinal direction (second direction) of the cleaning holder 51 is a direction orthogonal to the longitudinal direction (first direction) of the transmissive member 52 and the vertical direction. The widthwise direction of the cleaning holder 51 is the same as the longitudinal direction of the transmissive member 52. The longitudinal direction of the transmissive member 52 is the same as the main scanning direction of the laser beam L deflected by the rotary polygon mirror 41.

The guide rail 61 extends along the longitudinal direction of the transmissive member 52 and guides the movement of the cleaning holder 51. Further, two stoppers 56*a* and two stoppers 56*b* made of resin are provided at ends in the longitudinal direction of the guide rails 61, respectively. The stoppers 56*a* and 56*b* may be formed integrally with the cover 45*b* or may be formed separately from the cover 45*b*.

The cleaning holder 51 is connected to the wire 54. In other words, the cleaning holder 51 holds the wire 54. The wire 54 is annularly stretched by four tension pulleys 57 that are rotatably held by the cover 45*b*, the tension adjustment pulley 58, and the wire winding portion 59. Specifically, the wire 54 is stretched so as to be parallel to the longitudinal direction of the transmissive members 52 at positions between two adjacent transmission members 52.

The wire 54 annually travels by the driving force of the motor 55. The wire 54 is wound and adjusted in length by the wire winding portion 59 that is rotated by the driving force of the motor 55. As described above, the wire 54 is stretched by the tension pulleys 57, the tension adjustment pulley 58, and the wire winding portion 59, so that the tension of the wire 54 can be stabilized and the wire 54 may smoothly travel in an annular shape.

Further, as the wire 54 travels, the cleaning holder 51 moves in the longitudinal direction of the transmissive member 52 (the direction of the arrow K4 or the direction of the arrow K5 shown in FIG. 3). That is, the wire winding portion 59 driven by the driving force of the motor 55 and the wire 54 constitute a moving unit that moves the cleaning holder 51.

The cleaning holders 51*a* and 51*b* integrally hold two cleaning members 53 (53*a* to 53*d*) such that the connecting portion with the wire is located between two cleaning members 53. The cleaning member 53 is a rectangular rubber pad made of silicon rubber, and is disposed so as to be in contact with and pressed by the transmissive member 52. The materials of the cleaning holder 51 and the cleaning member 53 are not limited to these.

As the cleaning holder 51 moves, the cleaning member 53 moves in the longitudinal direction of the transmission member 52 (the direction of the arrow K4 or the arrow K5 shown in FIG. 3), namely along the scanning direction of the laser beam L deflected by the rotating polygon mirror 41 while the cleaning member 53 is in contact with the surface of the transmission member 52 on the outside of the cover 45*b*. That is, the moving direction of the cleaning member 53 is the same as the rotation axis direction of the photosensitive drum 10 and the direction of the scanning with the laser beam L deflected by the rotary polygon mirror 41. As a result, the cleaning member 53 scrapes and removes the adhering matter that has adhered to the surface of the transmissive member 52 and the foreign matter that has fallen on the surface of the transmitting member 52, thereby suppressing the laser beam L from being unintentionally blocked by the foreign matters.

The cover 45*b* is formed with the catch groove 66 that collects and holds the foreign matters removed by the cleaning member 53 at a position adjacent to the transmissive member 52 in the direction orthogonal to the moving direction of the cleaning member 53. The catch groove 66 is a groove formed below the surface of the transmissive member 52 in the thickness direction of the transmissive member 52.

<Cleaning Holder>

Next, the configuration of the cleaning holder 51 will be described in detail.

Figure 4:
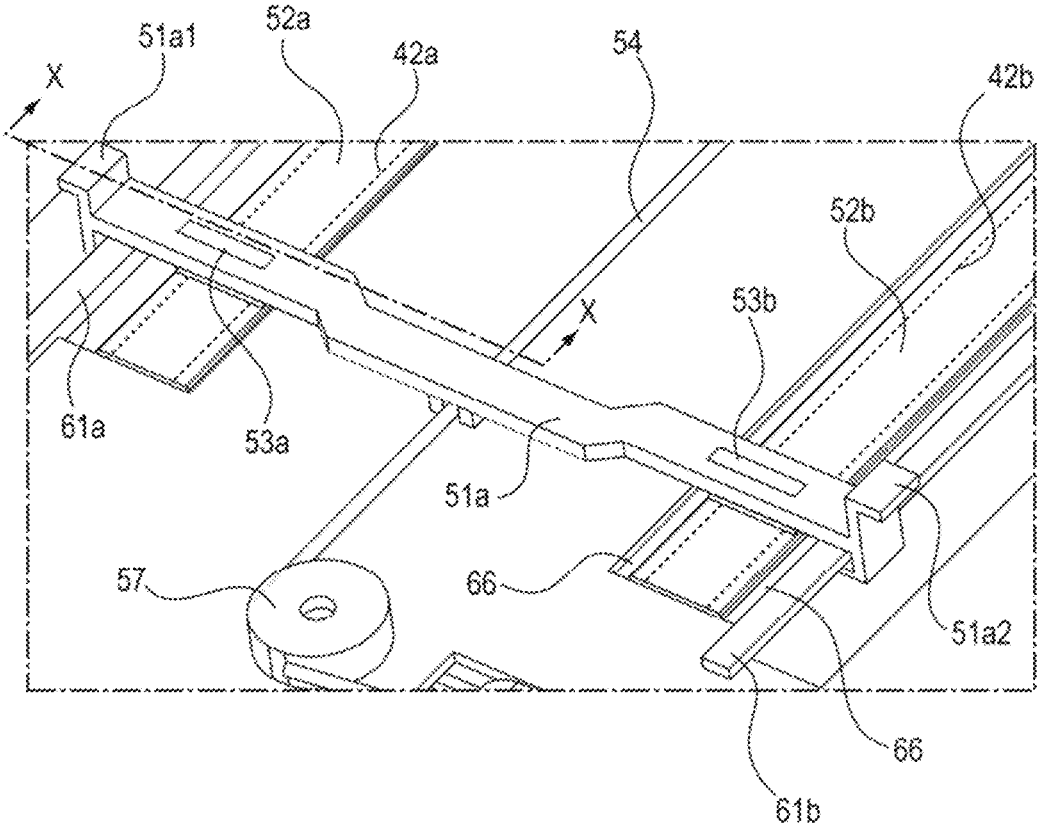
FIG. 4 is an enlarged perspective view of the periphery of a cleaning holder.
Figure 5:
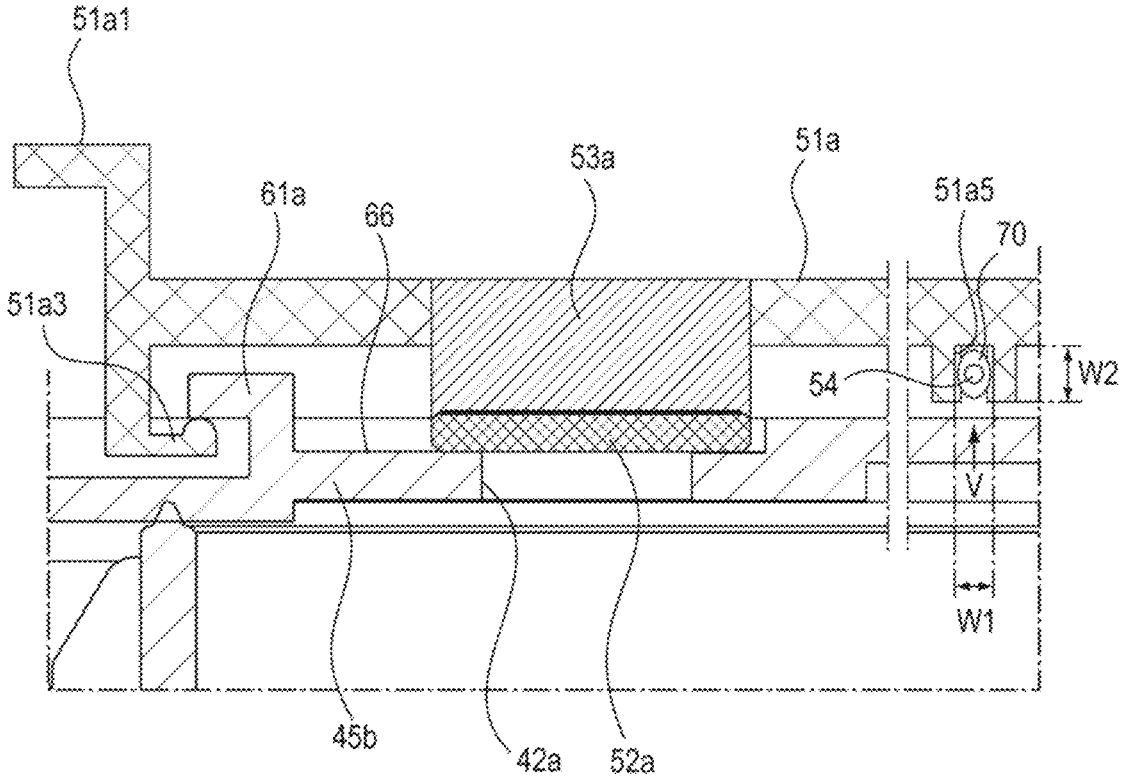
FIG. 5 is a cross-sectional view of a cleaning holder.
Figure 6:
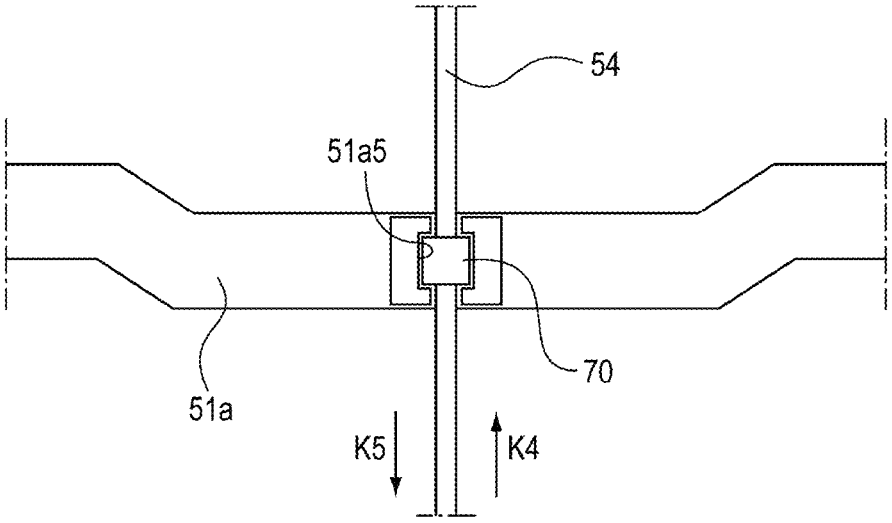
FIG. 6 is a view of a cleaning holder and a connecting member as seen from the direction of arrow V indicated in FIG. 5.

FIG. 4 is an enlarged perspective view of the periphery of the cleaning holder 51*a*. FIG. 5 is a cross-sectional view of the cleaning member 53 and the cleaning holder 51*a* taken along the line XX shown in FIG. 4. FIG. 6 is a view of the cleaning holder 51*a* and the connecting member 70 as seen from the direction of arrow V indicated in FIG. 5. Although the cleaning holder 51*a* will be described below, the cleaning holder 51*b* has the same shape.

As shown in FIGS. 4 to 6, the cleaning holder 51*a* has the protruding portion 51*a*1 (first protruding portion) protruding upward from the upper surface of the cleaning holder 51*a* at the position closer to the end portion of the cleaning holder 51*a* in the longitudinal direction of the cleaning holder 51*a* than the cleaning member 53*a*. Further, the cleaning holder 51*a* has the protruding portion 51*a*2 (second protruding portion) protruding upward from the upper surface of the cleaning holder 51*a* at the position closer to the end portion of the cleaning holder 51*a* in the longitudinal direction of the cleaning holder 51*a* than the cleaning member 53*b*.

The cleaning holder 51*a* includes the engaging portions 51*a*3 and 51*a*4 that respectively extend from the end portion in the longitudinal direction toward the central portion and respectively engage with the guide rails 61*a* and 61*b* such that the engaging portions 51*a*3 and 51*a*4 are respectively hooked by the guide rails 61*a* and 61*b*. That is, the engaging portion 51*a*3 on one end side in the longitudinal direction of the cleaning holder 51*a* engages with the guide rail 61*a* (first guide portion), and the engaging portion 51*a*4 on the other end side engages with the guide rail 61*b* (second guide portion).

The cylindrical connecting member 70 is attached to the wire 54. The wire 54 is inserted into the cylinder of the connecting member 70. The connecting member 70 is fitted into the fitting hole 51*a*5 provided in the cleaning holder 51*a*. As a result, the wire 54 and the cleaning holder 51*a* are connected, and the cleaning holder 51*a* moves as the wire 54 moves. In addition, by setting the relationship between the lengths W1 and W2 shown in FIG. 5 to be W2>W1, the wire 54 becomes hard to be twisted.

<Cleaning Mode>

Next, a cleaning mode for cleaning the surface of the transmissive member 52 will be described.

The cleaning mode is executed when a user operates an input device (not shown) such as a touch panel when the image forming apparatus A is in a maintenance state. In addition, the cleaning mode is executed in response to the fact that the number of formed images has reached a predetermined number since the previous cleaning operation. In addition, the execution timing of the cleaning mode is not limited to this and a different timing may be adopted.

When the cleaning mode is started, the motor 55 is first driven, and the wire 54 travels in the direction of the arrow K6 shown in FIG. 3. When the wire 54 travels, the cleaning holder 51*a* moves along the guide rail 61 in the direction of the arrow K4 shown in FIG. 3, and the cleaning holder 51*b* moves along the guide rail 61 in the direction of the arrow K5 shown in FIG. 3. With this movement, the four cleaning members 53 move while contacting the corresponding surfaces of the four transmissive members 52, respectively. With this movement, foreign matters on the transmissive members 52 are scraped off and removed from the transmissive members 52.

Thereafter, the cleaning holder 51*a* abuts against the stoppers 56*a* provided at one end of the moving path. As a result, the movement of the cleaning holders 51*a* and 51*b* is restricted. At this time, since the load acting on the motor 55 increases, it is possible to detect that the cleaning holders 51 abut against the stoppers by detecting the increase in the load. Then, the motor 55 starts reverse rotation in response to the detection of the increase in load, and the wire 54 also starts to travel in the reverse direction (the direction of the arrow K7 shown in FIG. 3).

Thereafter, the cleaning holder 51*b* abuts against the stoppers 56*b* provided at one end of the moving path. As a result, the movement of the cleaning holders 51*a* and 51*b* is restricted. As described above, since the load acting on the motor 55 increases at this time, it is possible to detect that the cleaning holders 51*a* and 51*b* abut against the stoppers 56*a* and 56*b* by detecting the increase in the load. Then, the motor 55 is stopped in response to the detection of the increase in load. Thus, in this embodiment, every time the cleaning mode is executed, the cleaning members 53 are reciprocated once along the longitudinal direction of the transmissive members 52.

<Attachment and Detachment of the Cleaning Holder>

Next, attachment and detachment of the cleaning holder 51 will be described.

Figure 7A:
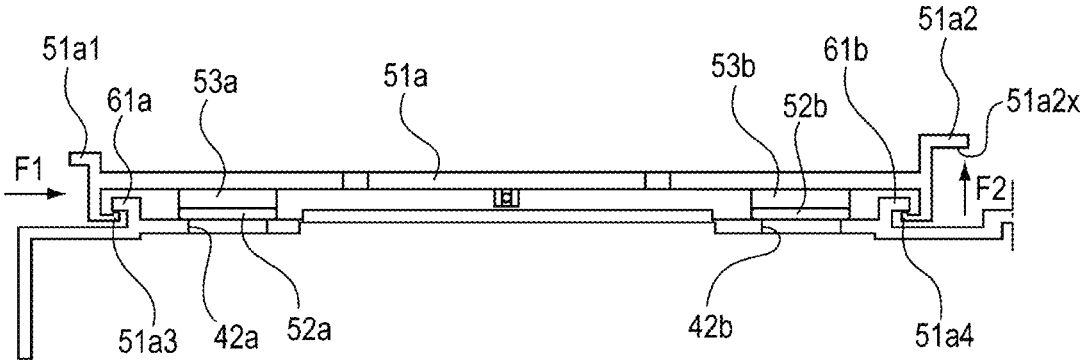
FIGS. 7A and 7B are a cross-sectional view of a cleaning holder.
Figure 7B:
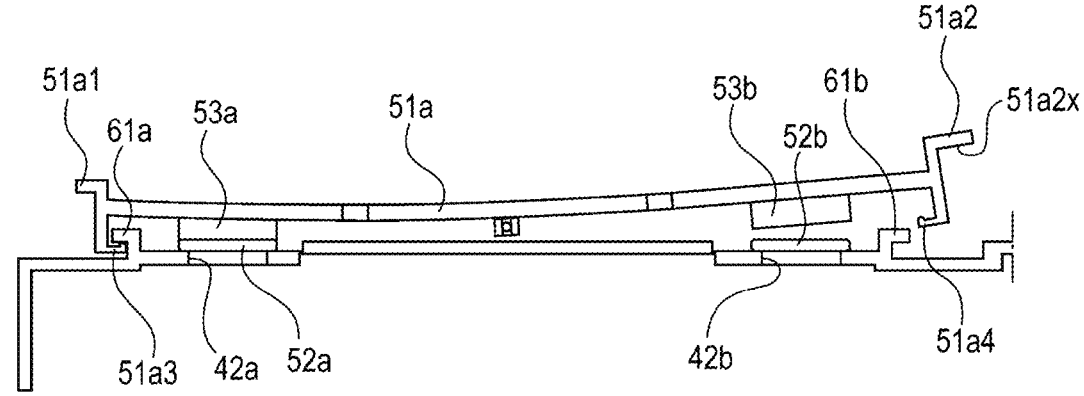
Figure 8:
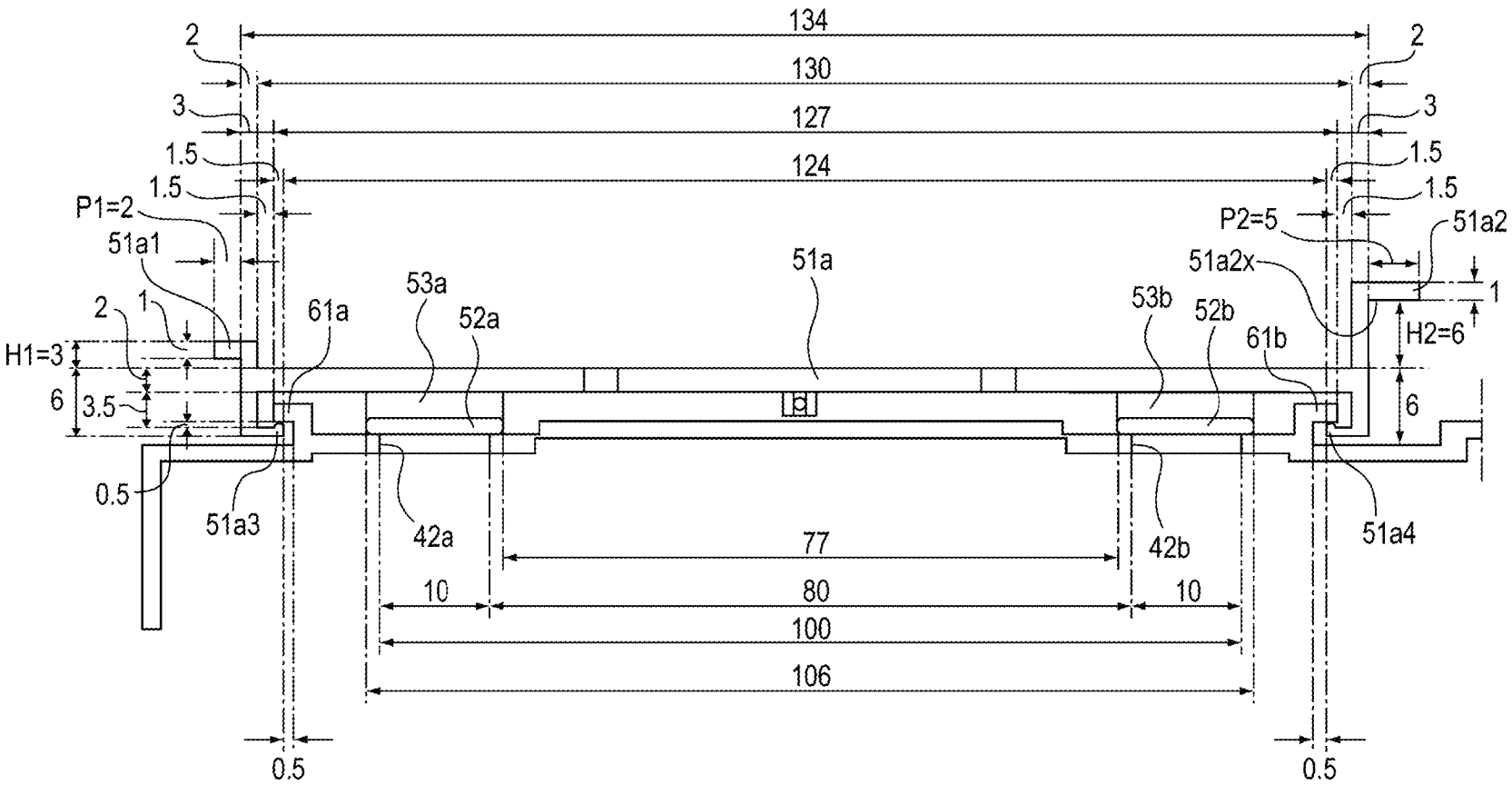
FIG. 8 is a view showing a dimensional relationship between a cleaning holder and a transmissive member.

FIGS. 7A and 7B are cross-sectional views of the cleaning holder 51*a* and show states in which the cleaning holder 51*a* is removed. FIG. 8 is a view showing a dimensional relationship between the cleaning holder 51*a* and the transmissive member 52. In the following, the attachment and detachment of only the cleaning holder 51*a* will be described since those of the cleaning holder 51*b* are similarly performed and the dimensional relationship of the cleaning holder 51*b* is similar to that of the cleaning holder 51*a*.

As shown in FIG. 7A, when removing the cleaning holder 51*a*, a maintenance worker first applies a force in the direction of the arrow F1 to the cleaning holder 51*a* by pushing the protruding portion 51*a*1 with a finger from the left side in FIG. 7A. By this operation, as shown in FIG. 7B, the cleaning holder 51*a* moves to the right side and a part of the engaging portion 51*a*3 abuts against the cover 45*b*. As a result, the engaging portion 51*a*4 of the cleaning holder 51*a* moves to the right side by 0.5 mm so that the engaging length with the guide rail 61*b* decreases from 1.5 mm to 1.0 mm and the engagement is weakened. In addition, as a result, the engaging length between the engaging portion 51*a*3 of the cleaning holder 51*a* and the guide rail 61*a* increases from 1.5 mm to 2.0 mm, and the engagement is strengthened.

Next, the worker inserts a finger below the pressing surface 51*a*2*x* of the protruding portion 51*a*2, presses the pressing surface 51*a*2*x* upward to apply a force in the direction of the arrow F2 to the cleaning holder 51*a*. In addition, when applying the force in the direction of the arrow F2, the worker does not necessarily need to insert a finger below the pressing surface 51*a*2*x*, and it may suffice that the worker only hooks a finger on the lower corner of the right end of the protruding portion 51*a*2 in FIG. 7B.

By the manual work of the worker, the force in the direction of the arrow F2 acts on the protruding portion 51*a*2 with the protruding portion 51*a*1 side being not substantially moved with respect to the cover 45*b*, so that the holder 51*a* bends in the longitudinal direction as shown in FIG. 7B. When the cleaning holder 51*a* bends, the engaging portion 51*a*4 further moves to the right side, and the engaging length between the engaging portion 51*a*4 and the guide rail 61*b* decreases from 1.0 mm to 0 so that the engagement between engaging portion 51*a*4 of the cleaning holder 51*a* and the guide rail 61*b* is released. Thereafter, the worker moves the cleaning holder 51*a* to the left side. As a result, the engaging length between the engaging portion 51*a*3 and the guide rail 61*a* decreases from 2 mm to 0 so that the engagement between them is released. Thereafter, the worker pulls the cleaning holder 51*a* upward so that the cleaning holder 51*a* can be removed from the guide rails 61*a* and 61*b*.

Moreover, when attaching the cleaning holder 51*a*, the worker engages the engaging portion 51*a*3 of the cleaning holder 51*a* with the guide rail 61*a*. Thereafter, the worker moves the cleaning holder 51*a* to the right side and abuts a part of the engaging portion 51*a*3 against the cover 45*b*. Thereafter, the worker presses the vicinity of the central portion in the longitudinal direction of the cleaning holder 51*a* while holding the protrusion 51*a*2 in the state in which the protrusion 51*a*1 side is not substantially moved with respect to the cover 45*b* so that the cleaning holder 51*a* bends in the longitudinal direction. When the cleaning holder 51*a* bends, the engaging portion 51*a*4 moves to the right side so that the engaging portion 51*a*4 can be engaged with the guide rail 61*b*. As a result, the cleaning holder 51*a* is attached to the guide rails 61*a* and 61*b*.

Thus, according to the configuration of the present embodiment, the cleaning holder 51*a* can be easily replaced. That is, when the cleaning holder 51*a* does not have the protrusions 51*a*1 and 51*a*2, it is difficult to remove the cleaning holder 51*a* so that it is difficult to replace the cleaning member 53. On the other hand, in this embodiment, the protrusion portions 51*a*1 and 51*a*2 for making the cleaning holder 51*a* bend to the longitudinal direction are provided on the cleaning holder 51*a*. As a result, it becomes easy to remove the cleaning holder 51*a*, and the exchangeability of the cleaning holder 51*a* and the cleaning members 53*a* and 53*b* can be improved.

Above the protruding portion 51*a*1, the process cartridge (not shown) in which the photosensitive drum 10, the charging roller 12 and the developing device 13 are integrated, is provided. Thus, if the length H1 of the protruding portion 51*a*1 shown in FIG. 8 is too long, there is a possibility that the insertion of the process cartridge is prevented. Therefore, the length H1 of the protrusion 51*a*1 is preferably 0 mm<H1≤15 mm. In this embodiment 3 mm is adopted.

Further, as described above, when removing the cleaning holder 51*a*, a load is applied to the protruding portion 51*a*1 side to create a fulcrum. Here, by setting the relationship between the length H1 of the protruding portion 51*a*1 and the length H2 of the protruding portion 51*a*2 to H1<H2, the distance between the pressing surface 51*a*2*x* of the protruding portion 51*a*2 from the fulcrum becomes longer. As a result, the cleaning holder 51*a* may be bent with a small load. In this embodiment, H1=3 mm and H2=6 mm, which satisfy this relationship.

The length P1 of the portion extending from the protruding portion 51*a*1 in the longitudinal direction of the cleaning holder 51*a* and the length P2 of the portion extending from the protruding portion 51*a*2 in the longitudinal direction of the cleaning holder 51*a* has the relationship of P1<P2. As a result, the surface of the pressing surface 51*a*2*x* for being in contact with a finger becomes relatively large, so that it is easy to apply a load to the cleaning holder 51*a*. In this embodiment, P1=2 mm and P2=5 mm, which satisfy this relationship.

Figure 9A:
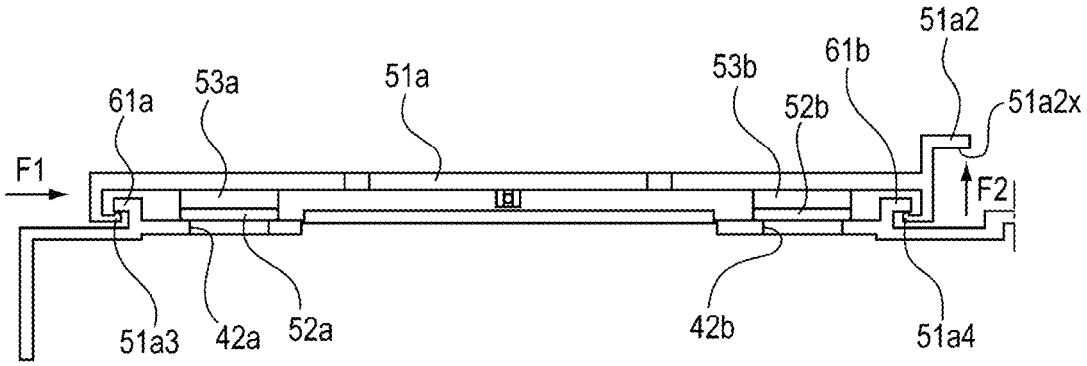
FIGS. 9A and 9B are a view showing another configuration of the cleaning holder.
Figure 9B:
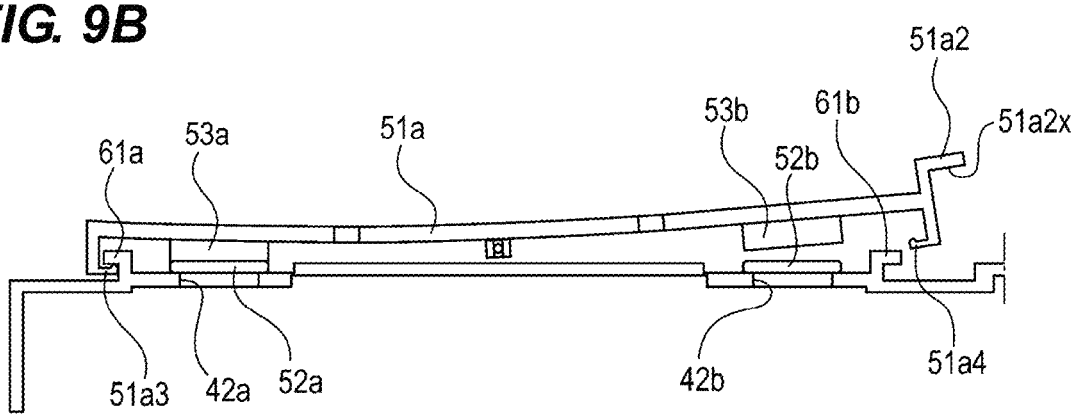

Moreover, in this embodiment, the two protruding portions 51*a*1 and 51*a*2 are provided on the cleaning holder 51*a*. However, this invention is not limited to this. That is, as shown in FIGS. 9A and 9B, only the single protruding portion 51*a*2 may be provided at a position closer to the end portion side than the cleaning member 53.

In this case, when removing the cleaning holder 51*a*, a maintenance worker first applies a force in the direction of the arrow F1 to the cleaning holder 51*a* by pushing the end surface of the side opposite to the side on which the protruding portion 51*a*2 is provided. By this operation, the cleaning holder 51*a* moves to the right side and a part of the engaging portion 51*a*3 abuts against the cover 45*b*.

Next, the worker inserts a finger below the pressing surface 51*a*2*x* of the protruding portion 51*a*2, presses the pressing surface 51*a*2*x* upward to apply a force in the direction of the arrow F2 to the cleaning holder 51*a*. In addition, when applying the force in the direction of the arrow F2, the worker does not necessarily need to insert a finger below the pressing surface 51*a*2*x*, and it may suffice that the worker only hooks a finger on the lower corner of the right end of the protruding portion 51*a*2. As a result, the cleaning holder 51*a* can be removed similarly to the above description, and the exchangeability of the cleaning holder 51*a* and the cleaning members 53*a* and 53*b* can be improved.

Figure 10:
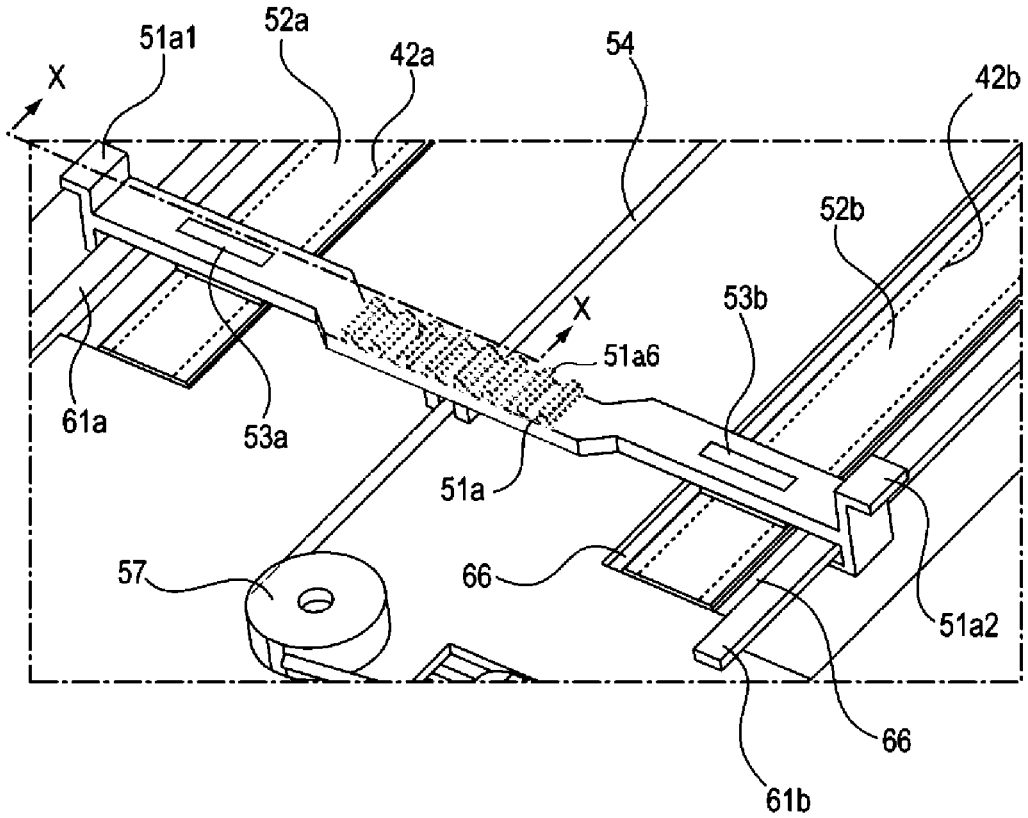
FIG. 10 is a view showing another configuration of the cleaning holder.

Further, as shown in FIG. 10, a plurality of ribs 51*a*6 extending in the widthwise direction of the cleaning holder 51*a* are provided at a position between the cleaning member 53*a* and the cleaning member 53*b* in the longitudinal direction of the cleaning holder 51*a* on the cleaning holder 51*a*. Accordingly, when a force is applied to the cleaning holder 51*a* when removing the cleaning holder 51*a*, the cleaning holder 51*a* is less likely to bend in the widthwise direction, and the cleaning holder 51 can be prevented from being damaged.

Second Embodiment

Next, the configuration of the image forming apparatus according to the second embodiment of the present invention will be described. The same parts as those in the first embodiment will be denoted by the same reference numerals and the description thereof will be omitted.

Figure 11:
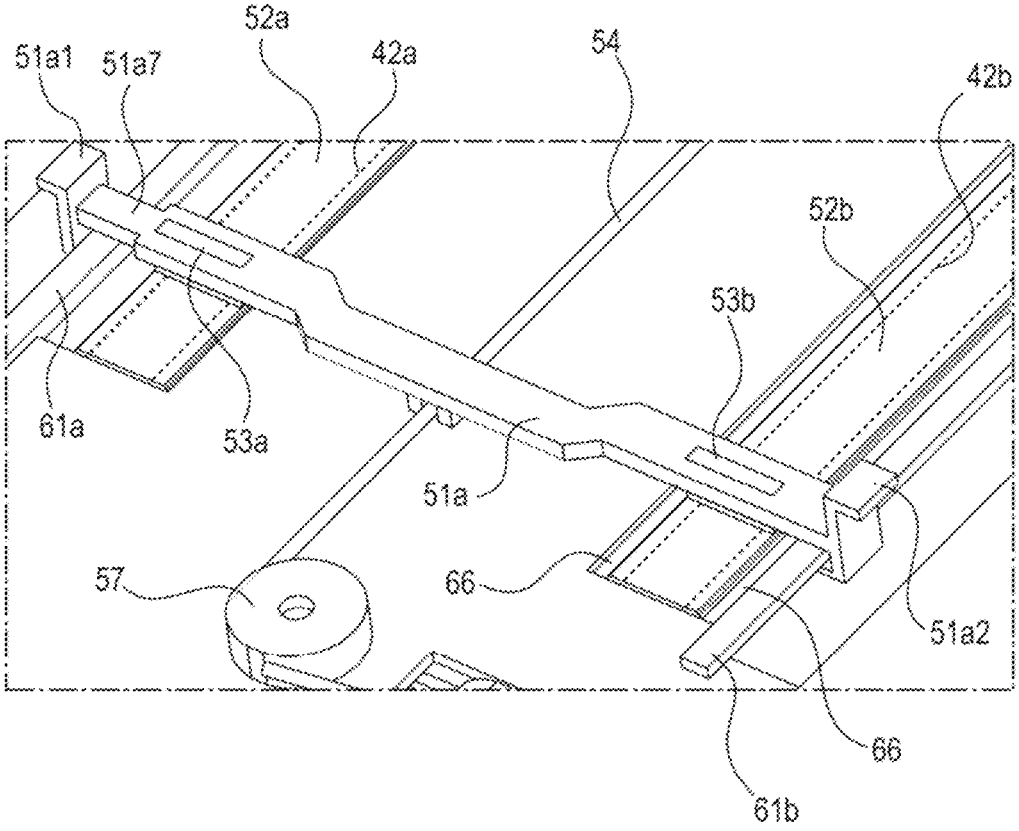
FIG. 11 is a perspective view of the cleaning holder.

FIG. 11 is a perspective view of the cleaning holder 51*a* according to the present embodiment. In the following, although the cleaning holder 51*a* will be described, the cleaning holder 51*b* has the same shape.

As shown in FIG. 11, the cleaning holder 51*a* of the present embodiment has the recess 51*a*7 (recessed portion) that is recessed in the widthwise direction at a position adjacent to the protruding portions 51*a*1 and 51*a*2 in the longitudinal direction. Other configurations are the same as those of the first embodiment.

By providing the recess 51*a*7 in this manner, when the operator applies a force to the cleaning holder 51*a* when removing the cleaning holder 51*a*, the cleaning holder 51*a* is easily bent in the longitudinal direction since the strength of the recess 51*a*7 is weak. Therefore, the cleaning holder 51*a* can be easily detached from the guide rails 61*a* and 61*b*, and the exchangeability of the cleaning holder 51*a* and the cleaning members 53*a* and 53*b* can be further improved.

In the present embodiment, the cleaning holder 51*a* is easily bent by the recess 51*a*7. However, for example, the cleaning holder 51*a* may be configured to be easily bent by reducing the thickness of a part of the cleaning holder 51*a* or by forming a hollow shape.

Third Embodiment

Next, the configuration of the image forming apparatus according to the third embodiment of the present invention will be described. The same parts as those in the first and second embodiments will be denoted by the same reference numerals and the description thereof will be omitted.

Figure 12:
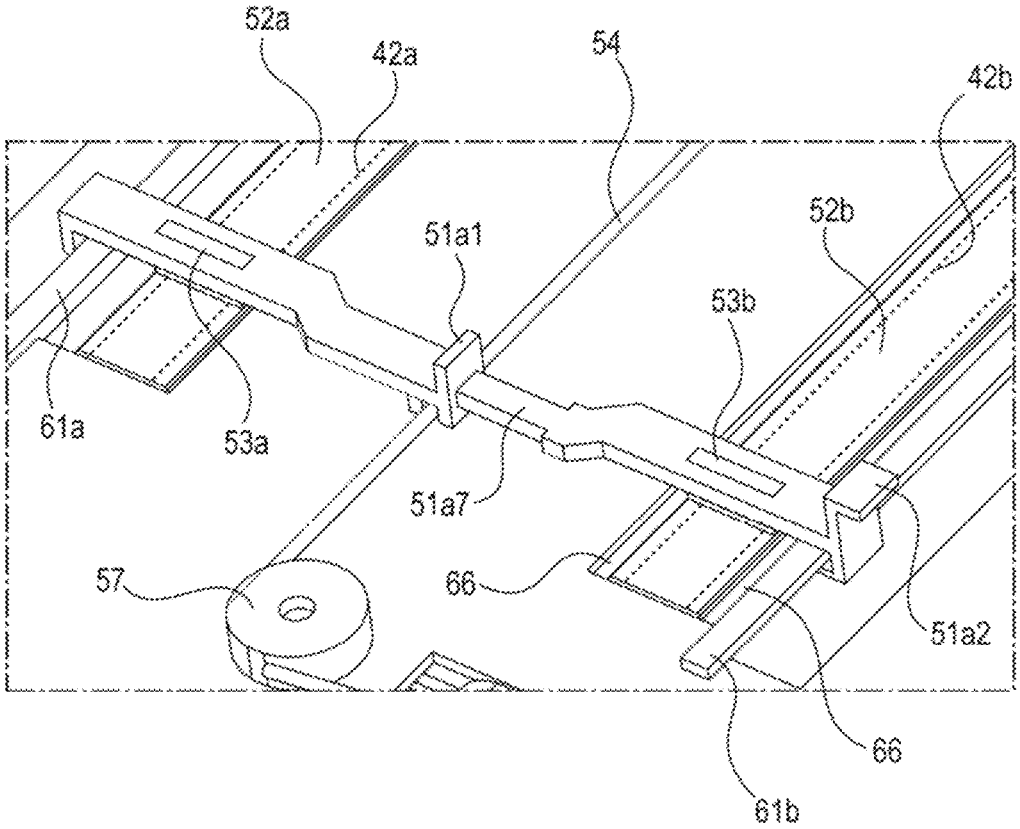
FIG. 12 is a perspective view of the cleaning holder.

FIG. 12 is a perspective view of the cleaning holder 51*a* according to the present embodiment. In the following, although the cleaning holder 51*a* will be described, the cleaning holder 51*b* has the same shape.

As shown in FIG. 12, the cleaning holder 51*a* of this embodiment has the protruding portion 51*a*1 protruding upward from the upper surface of the cleaning holder 51 at a position between the cleaning member 53*a* and the cleaning member 53*b* in the longitudinal direction. Moreover, the cleaning holder 51 has the recess 51*a*7 recessed in the widthwise direction at the position adjacent to the protruding portion 51*a*1 in the longitudinal direction of the cleaning holder 51. Other configurations are the same as those of the first embodiment.

Thus, even in the configuration in which the protruding portion 51*a*1 is provided at a position between the cleaning member 53*a* and the cleaning member 53*b*, the cleaning holder 51 can be easily removed in the same manner as the configuration in which the protruding portion is provided at a position closer to the end portion side than the cleaning member 53*a*. Furthermore, since the distance between the protruding portions 51*a*1 and 51*a*2 is reduced, it may be possible for a worker to remove the cleaning holder 51*a* with one hand. Therefore, the exchangeability of the cleaning holder 51*a* and the cleaning members 53*a* and 53*b* can be improved.

By providing the recess 51*a*7 in this manner, when the operator applies a force to the cleaning holder 51*a* when removing the cleaning holder 51*a*, the cleaning holder 51*a* is easily bent in the longitudinal direction since the strength of the recess 51*a*7 is weak. Therefore, the cleaning holder 51*a* can be easily detached from the guide rails 61*a* and 61*b*, and the exchangeability of the cleaning holder 51*a* and the cleaning members 53*a* and 53*b* can be further improved.

In the present embodiment, the cleaning holder 51*a* is easily bent by the recess 51*a*7. However, for example, the cleaning holder 51*a* may be configured to be easily bent by reducing the thickness of a part of the cleaning holder 51*a* or by forming a hollow shape.

Fourth Embodiment

Next, the configuration of the image forming apparatus according to the fourth embodiment of the present invention will be described. The same parts as those in the first, second and third embodiments will be denoted by the same reference numerals and the description thereof will be omitted.

Figure 13A:
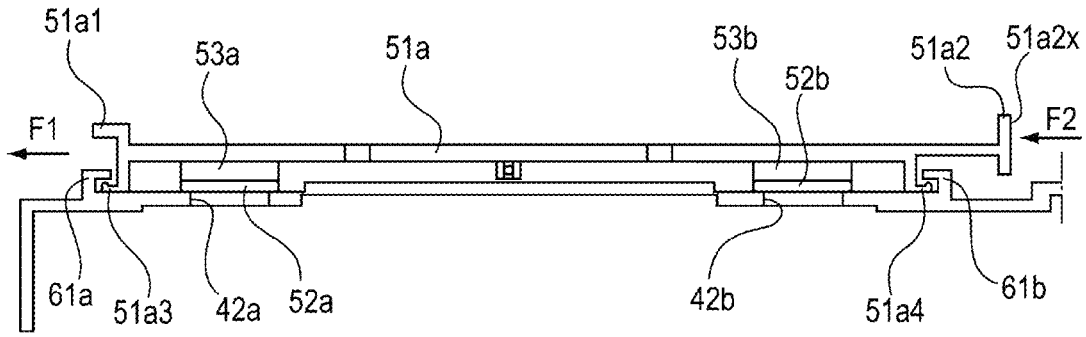
FIGS. 13A and 13B are a cross-sectional view of the cleaning holder.
Figure 13B:
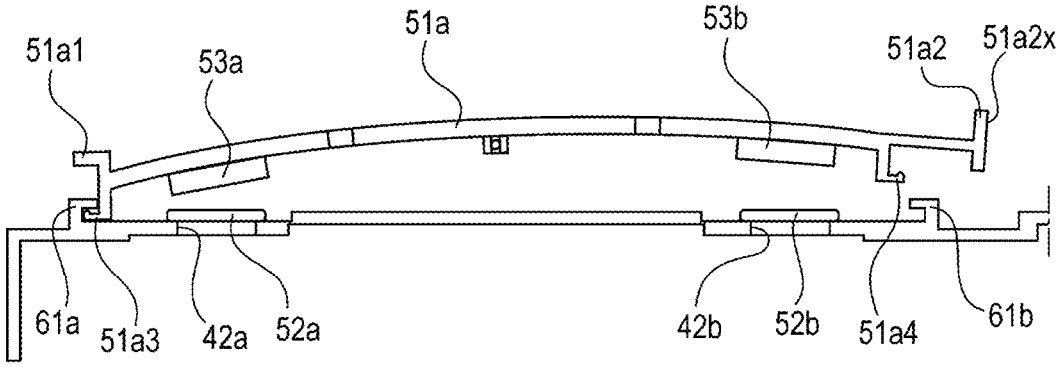
Figure 14:
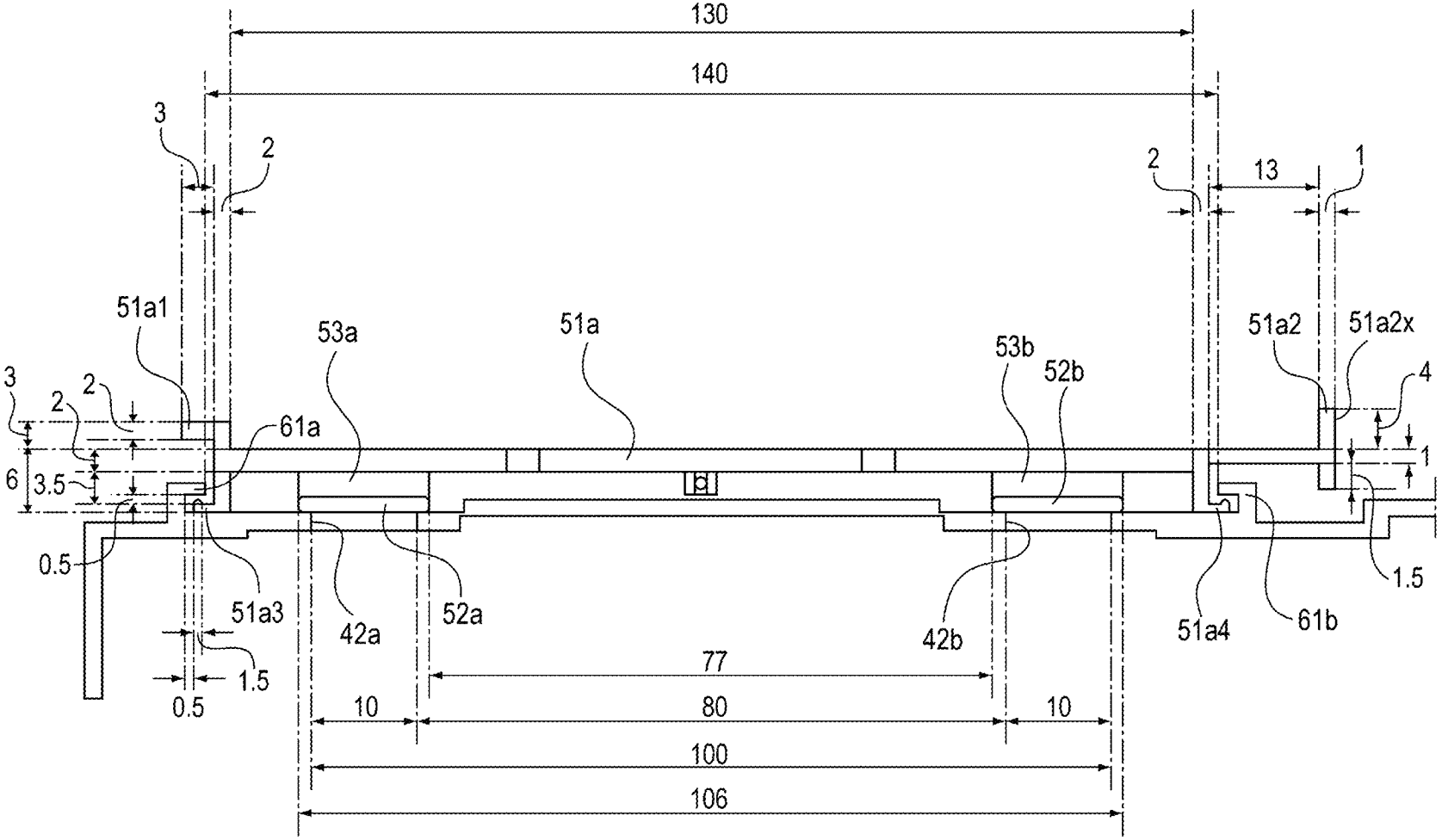
FIG. 14 is a view showing a dimensional relationship between a cleaning holder and a transmissive member.

FIGS. 13A and 13B are sectional views of the cleaning holder 51*a* according to this embodiment, and sequentially showing how the cleaning holder 51*a* is removed. FIG. 14 is a view showing a dimensional relationship between the cleaning holder 51*a* and the transmission member 52 according to the present embodiment. In the following, although the cleaning holder 51*a* will be described, the cleaning holder 51*b* has the same shape.

As shown in FIGS. 13A and 13B, the configuration of the present embodiment differs from the configuration of the first embodiment in how the cleaning holder 51*a* and the guide rails 61*a* and 61*b* are engaged, and the shape of the protruding portion 51*a*2. Specifically, the engaging portions 51*a*3 and 51*a*4 of the cleaning holder 51*a* extend from the central side to the end portion side in the longitudinal direction of the cleaning holder 51. The engaging portions 51*a*3 and 51*a*4 engage with the guide rails 61*a* and 61*b* such that the engaging portions are hooked by the guide rails from inside. Other configurations are the same as those of the first embodiment.

As shown in FIG. 13A, when removing the cleaning holder 51*a*, a worker first pushes the protruding portion 51*a*1 from the right side in FIG. 13A with a finger to apply a force in the direction of the arrow F1. By this operation, as shown in FIG. 13B, the cleaning holder 51*a* moves to the left side and a part of the engaging portion 51*a*3 abuts against the cover 45*b*. As a result, the engaging portion 51*a*4 of the cleaning holder 51*a* moves to the left by 0.5 mm, so that the engaging length with the guide rail 61*b* decreases from 1.5 mm to 1.0 mm, and the engagement is weakened.

Next, the worker presses the pressing surface 51*a*2*x* of the protruding portion 51*a*2 of the cleaning holder 51*a* to the left side to apply a force in the direction of arrow F2 to the cleaning holder 51*a*. At this time, even without the protruding portion 51*a*2, it is possible to apply a force in the direction of arrow F2, but the presence of the protruding portion 51*a*2 increases the area of the pressing surface 51*a*2*x*, and the worker more easily presses the cleaning holder 51*a* to the arrow F2.

By the manual work of the worker, the force in the direction of the arrow F2 acts on the protruding portion 51*a*2 with the protruding portion 51*a*1 side being not substantially moved with respect to the cover 45*b*, so that the holder 51*a* bends in the longitudinal direction as shown in FIG. 13B. As the cleaning holder 51*a* is bent, the length between the engaging portions 51*a*3 and 51*a*4 of about 141.5 mm in a free state where no load is applied becomes shorter than the length (140 mm) between the guide rails 61*a* and 61*b*. As a result, the engaging portion 51*a*4 of the cleaning holder 51*a* is disengaged from the guide rail 61*b*. Thereafter, the worker moves the cleaning holder 51*a* to the right side. As a result, the engaging length between the engaging portion 51*a*3 and the guide rail 61*a* decreases from 2 mm to 0, and the engagement between them is released. After that, the worker pulls the cleaning holder 51*a* upward. As a result, the worker can remove the cleaning holder 51*a* from the guide rails 61*a* and 61*b*.

Thus, even if the cleaning holder 51*a* is configured to engage with the guide rails 61*a* and 61*b* from the inside, by providing the protruding portions 51*a*1 and 51*a*2, the exchangeability of the cleaning holder 51*a* and the cleaning members 53*a* and 53*b* can be improved.

Further, in the first and second embodiments, the configurations in which four transmission members 52 are respectively provided for the four irradiation openings 42 have been described, but the present invention is not limited to this. That is, as long as their functions can be performed, the number of the irradiation portions 42 and the number of the transmissive members 52 are arbitrary, and the same effect as described above can be obtained even with the configuration with other numbers of the irradiation portions and the transmissive members.

Moreover, the configuration in which the ribs 51*a*6 are provided, described using FIG. 10 in the first embodiment is applicable also to other embodiments. As a result, also in other embodiments, the cleaning holder 51 becomes hard to bend in the widthwise direction, and it can suppress the cleaning holder 51 from being damaged.

Figure 15:
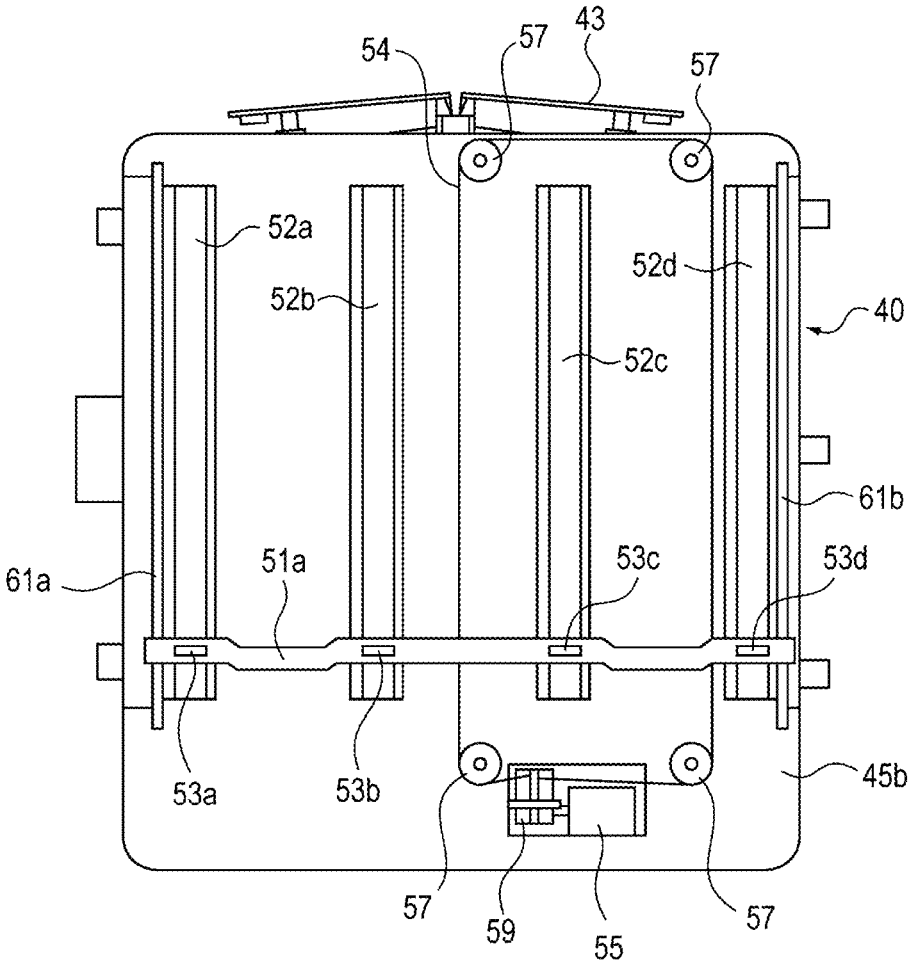
FIG. 15 is a view showing another configuration of the optical scanning device.

In the first and second embodiments, the configurations in which the two cleaning members 53 are held by the single cleaning holder 51*a* or 51*b* have been described. However, the present invention is not limited to this. Namely, as shown in FIG. 15, the four cleaning members 53 may be held by the single cleaning holder 51*a*.

In this case, for example, the cleaning holder 51*a* is engaged with the guide rails 61*a* and 61*b* provided respectively at positions closer to the end portions of the cleaning holder 51*a* than those of the transmissive members 52*b* and 52*c*. Further, the cleaning holder 51*a* is connected to the wire 54 at a position between the transmissive members 52*b* and 52*c*. With this configuration, the replacement of the cleaning member 53 is completed by replacing only the single cleaning holder 51*a*. Therefore, the exchangeability of the cleaning member 53 can be improved. Further, the manufacturing cost can be reduced by reducing the number of parts.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-227619, filed Dec. 4, 2018, which is hereby incorporated by reference herein in its entirety.

What is claimed is:

1. An image forming apparatus, comprising:

a first photosensitive body;

a second photosensitive body;

a first developing portion configured to develop an electrostatic latent image formed on the first photosensitive body with toner;

a second developing portion configured to develop an electrostatic latent image formed on the second photosensitive body with toner; and an optical scanning device disposed below the first photosensitive body, the second photosensitive body, the first developing portion and the second developing portion in a vertical direction, wherein the optical scanning device comprises:

a rotary polygon mirror configured to deflect a first laser beam and a second laser beam such that the first laser beam scans the first photosensitive body and the second laser beam scans the second photosensitive body;

a housing in which the rotary polygon mirror is accommodated, a first opening portion through which the first laser beam passes from an inside of the housing to an outside of the housing and a second opening portion through which the second laser beam passes from the inside of the housing to the outside of the housing being formed on the housing, the first opening portion being configured to be long in a scanning direction of the first laser beam, the second opening portion being configured to be long in a scanning direction of the second laser beam;

a first transmissive member through which the first laser beam transmits, the first transmissive member being configured to close the first opening portion;

a second transmissive member through which the second laser beam transmits, the second transmissive member being configured to close the second opening portion;

a first cleaning member configured to be in contact with a surface of the first transmissive member which surface faces the outside of the housing in order to clean the surface of the first transmissive member;

a second cleaning member configured to be in contact with a surface of the second transmissive member which surface faces the outside of the housing in order to clean the surface of the second transmissive member;

a holding member configured to integrally hold the first cleaning member and the second cleaning member, the holding member having flexibility;

a moving unit configured to move the holding member such that the first cleaning member and the second cleaning member move in a first direction that is a longitudinal direction of the first transmissive member and the second transmissive member;

a first guide portion configured to guide a movement of the holding member, the first guide portion extending in the first direction, an end portion side of the holding member in a second direction that crosses the first direction and the vertical direction being configured to engage with the first guide portion;

a second guide portion configured to guide a movement of the holding member, the second guide portion extending in the first direction, another end portion side of the holding member in the second direction being configured to engage with the second guide portion, and a protruding portion disposed on the holding member, wherein the protruding portion includes a surface constructed for manipulation by a worker so as to release an engagement between the end portion side of the holding member and the first guide portion by deforming elastically the holding member.

2. The image forming apparatus according to claim 1, wherein a plurality of ribs extending in the first direction are provided on the holding member between the first cleaning member and second cleaning member in the second direction.

3. The image forming apparatus according to claim 1, wherein the protruding portion projects from an upper surface of the holding member.

4. The image forming apparatus according to claim 1, wherein the protruding portion is provided at the end portion side of the holding member in the second direction.

5. The image forming apparatus according to claim 4, wherein a first engaging portion is disposed on the end portion side of the holding member, the first engaging portion being inserted to the first guide portion from an opposite side in the second direction to a side where the second guide portion is disposed, and engaged with the first guide portion, wherein a second engaging portion is disposed on said another end portion side of the holding member, the second engaging portion being inserted to the second guide portion from an opposite side in the second direction to a side where the first guide portion is disposed, and engaged with the second guide portion, and wherein in a view of looking the holding member in the vertical direction, the protruding portion is positioned at an opposite side in the second direction to the side where the second guide portion is disposed against the first guide portion, and is configured to be held by the worker so as to deform elastically the holding member projecting downward.

6. The image forming apparatus according to claim 4, wherein a first engaging is disposed on the end portion side of the holding member, the first engaging portion being inserted and engaged to the first guide portion in a direction from the second guide portion to the first guide portion, wherein a second engaging portion is disposed on said another end portion side of the holding member, the second engaging portion being inserted and engaged to the second guide portion in a direction from the first guide portion to the second guide portion, and wherein in a view of looking the holding member in the vertical direction, the protruding portion is positioned at an opposite side in the second direction to the side where the second guide portion is disposed against the first guide portion, and is configured such that the surface is manipulable by the worker so as to deform elastically the holding member projecting upward.

7. The image forming apparatus according to claim 4, further comprising:

a further protruding portion other than the protruding portion which is disposed on said another end portion side of the holding member in the second direction, wherein the further protruding portion includes a further surface constructed for manipulation by a worker so as to release an engagement between the end portion side of the holding member and the second guide portion by deforming elastically the holding member.

8. The image forming apparatus according to claim 7, wherein the protruding portion and the further protruding portion project from an upper surface of the holding member upward.

9. The image forming apparatus according to claim 7, wherein a first engaging portion is disposed on the end portion side of the holding member, the first engaging portion being inserted to the first guide portion from an opposite side in the second direction to a side where the second guide portion is disposed, and engaged with the first guide portion, wherein a second engaging portion is disposed on said another end portion side of the holding member, the second engaging portion being inserted to the second guide portion from an opposite side in the second direction to a side where the first guide portion is disposed, and engaged with the second guide portion, and wherein in a view of looking the holding member in the vertical direction, the protruding portion is positioned at an opposite side in the second direction to the side where the second guide portion is disposed against the first guide portion, the further protruding portion is positioned at an opposite side in the second direction to the side where the first guide portion is disposed against the second guide portion, and the protruding portion and the further protruding portion are configured such that the surface and the further surface are manipulable by the worker so as to deform elastically the holding member projecting downward.

10. The image forming apparatus according to claim 7, wherein a first engaging portion is disposed on the end portion side of the holding member, the first engaging portion being inserted and engaged to the first guide portion in a direction from the second guide portion to the first guide portion, wherein a second engaging portion is disposed on said another end portion side of the holding member, the second engaging portion being inserted and engaged to the second guide portion in a direction from the first guide portion to the second guide portion, and wherein in a view of looking the holding member in the vertical direction, the protruding portion is positioned at an opposite side in the second direction to the side where the second guide portion is disposed against the first guide portion, and is configured such that the surface is manipulable by the worker so as to deform elastically the holding member projecting upward.

11. The image forming apparatus according to claim 1 wherein, the moving unit further comprises:

a wire having the holding member; and a motor configured to drive the wire for making the first cleaning member to clean the first transmissive member as well as the second cleaning member to clean the second transmissive member.

12. An image forming apparatus, comprising:

a first photosensitive body;

a second photosensitive body;

a first developing portion configured to develop an electrostatic latent image formed on the first photosensitive body with toner;

a second developing portion configured to develop an electrostatic latent image formed on the second photosensitive body with toner; and an optical scanning device disposed below the first photosensitive body, the second photosensitive body, the first developing portion and the second developing portion in a vertical direction, wherein the optical scanning device comprises:

a rotary polygon mirror configured to deflect a first laser beam and a second laser beam such that the first laser beam scans the first photosensitive body and the second laser beam scans the second photosensitive body;

a housing in which the rotary polygon mirror is accommodated, a first opening portion through which the first laser beam passes from an inside of the housing to an outside of the housing and a second opening portion through which the second laser beam passes from the inside of the housing to the outside of the housing being formed on the housing, the first opening portion being configured to be long in a scanning direction of the first laser beam, the second opening portion being configured to be long in a scanning direction of the second laser beam;

a first transmissive member through which the first laser beam transmits, the first transmissive member being configured to close the first opening portion;

a second transmissive member through which the second laser beam transmits, the second transmissive member being configured to close the second opening portion;

a first cleaning member configured to be in contact with a surface of the first transmissive member which surface faces the outside of the housing in order to clean the surface of the first transmissive member;

a second cleaning member configured to be in contact with a surface of the second transmissive member which surface faces the outside of the housing in order to clean the surface of the second transmissive member;

a holding member configured to integrally hold the first cleaning member and the second cleaning member, the holding member having flexibility;

a moving unit configured to move the holding member such that the first cleaning member and the second cleaning member move in a first direction that is a longitudinal direction of the first transmissive member and the second transmissive member;

a first guide portion configured to guide a movement of the holding member, the first guide portion extending in the first direction, an end portion side of the holding member in a second direction that crosses the first direction and the vertical direction being configured to engage with the first guide portion; and a second guide portion configured to guide a movement of the holding member, the second guide portion extending in the first direction, another end portion side of the holding member in the second direction being configured to engage with the second guide portion, and wherein a first protruding portion that protrudes upward from an upper surface of the holding member is provided on the holding member between the first cleaning member and the second cleaning member in the second direction, and a second protruding portion that protrudes upward from the upper surface of the holding member is provided on the holding member at a position closer to an end portion of the holding member in the second direction than the second cleaning member, the first protruding portion and second protruding portion being for bending the holding member in the second direction.

13. The image forming apparatus according to claim 12, wherein the holding member includes an engaging portion extending from an end portion side to a central portion side in the second direction such that the engaging portion is hooked by the guide portion and the second guide portion.

14. The image forming apparatus according to claim 12, wherein the holding member includes an engaging portion extending from a central portion side to an end portion side in the second direction such that the engaging portion is hooked by the guide portion and the second guide portion.

15. The image forming apparatus according to claim 12, wherein the holding member includes a recessed portion at a position adjacent to the first protruding portion, the recessed portion being recessed in the first direction.

16. The image forming apparatus according to claim 12, wherein a plurality of ribs extending in the first direction are provided on the holding member between the first cleaning member and second cleaning member in the second direction.

* * * * *